United States Patent [19]

Morris

[11] 3,939,668

[45] Feb. 24, 1976

[54] BALANCED LIQUID LEVEL HEAD PRESSURE CONTROL SYSTEMS

[76] Inventor: Herman H. Morris, P.O. Box 3129, Chattanooga, Tenn. 37404

[22] Filed: Nov. 21, 1974

[21] Appl. No.: 525,937

[52] U.S. Cl. ..... 62/196; 62/117

[51] Int. Cl.[2] ..... F25B 41/00

[58] Field of Search ..... 62/117, 196

[56] References Cited

UNITED STATES PATENTS

| | | | |
|---|---|---|---|
| 2,874,550 | 2/1959 | Musson | 62/196 |
| 2,986,899 | 6/1961 | Schenk | 62/196 |
| 3,103,795 | 9/1963 | Tilney | 62/196 |
| 3,248,895 | 3/1966 | Mauer | 62/196 |

*Primary Examiner*—William J. Wye

*Attorney, Agent, or Firm*—Hill, Gross, Simpson, Van Santen, Steadman, Chiara & Simpson

[57] ABSTRACT

A refrigerant condenser system employs a three-way valve in the output line from the system compressor. Upon cold start-up of the system or excess condenser capacity, the valve directs hot compressed vapor to a liquid receiver to increase the pressure therein forcing liquid therefrom in a reverse flow to the condenser to raise its liquid level and thereby decrease its cooling capacity. Upon a rise in system pressure, the valve opens to direct some vapor, in proportion to the pressure, to the condenser, reducing condenser liquid level to the extent necessary to obtain adequate cooling capacity in the condenser. At maximum cooling load and high ambient temperature, all vapor will be directed by the valve to the condenser to obtain maximum cooling capacity.

2 Claims, 1 Drawing Figure

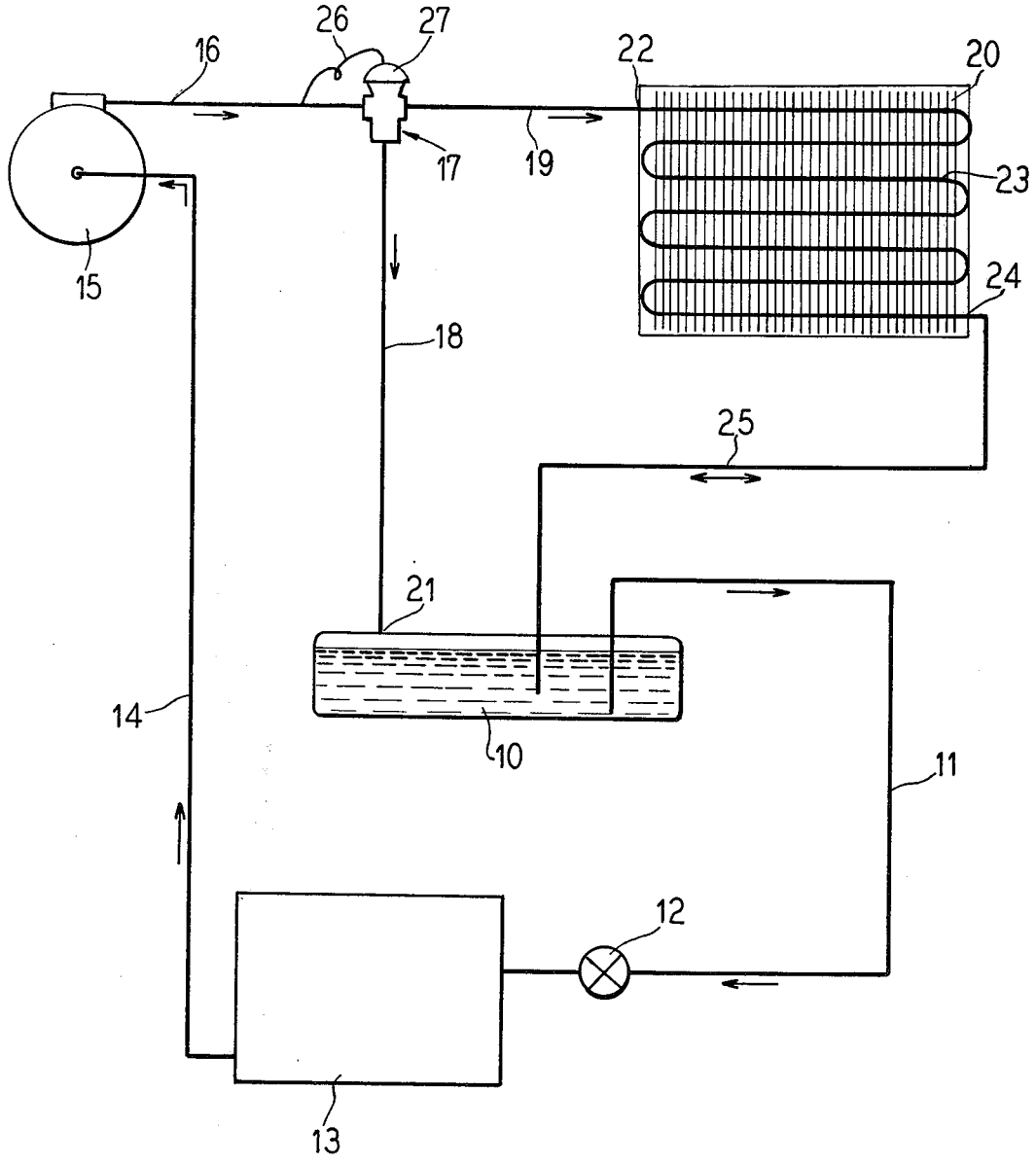
26
27
16
22
20
17
19
23
15
24
18
25
21
14
10
11
12
13

BALANCED LIQUID LEVEL HEAD PRESSURE CONTROL SYSTEMS

BACKGROUND OF THE INVENTION

1. Field of the Invention

This invention relates to a method and apparatus for controlling liquid level in a pressurized refrigerant condenser system.

2. Description of the Prior Art

In the design of refrigeration condensers, it is imperative that adequate heat transfer surface be provided for the maximum output of the system compressor and at the maximum design ambient temperature to assure adequate condensing capacity.

The maximum compressor output of an adequately designed system would more probably occur at the time the ambient temperature reaches or exceeds the design temperature. Many conditions exist in which the compressor is required to operate at reduced capacity, and outside ambient temperature is often lower than the design temperature, and the condenser thereupon provides too much condensing capacity. Low compressor head pressure and accompanying problems of inadequate refrigerant flow and low suction result.

Existing head pressure control systems utilize variable speed and cycled condenser fans, condenser face dampers, and pressure sensitive refrigerant hold back valves on the condenser outlet line.

SUMMARY OF THE INVENTION

In accordance with the present invention, hot refrigerant gas is supplied from the compressor to a three-way gas valve. The three-way valve is controlled as a function of the refrigerant hot gas discharge pressure from the compressor in a conventional manner thru an internal port, a capillary tube sensing the compressor discharge pressure or, in the case of pneumatic or electronic controls, a sensor transmitting the compressor discharge pressure thru the proper signal to the three-way valve actuator. The operation of the three-way valve is to throttle valve outlet to the liquid receiver and to correspondingly open the valve port to the condenser upon an increase in compressor refrigerant discharge pressure. The condenser normally empties to the liquid receiver through a line which also accepts reverse flow. Upon system start-up, or whenever compressor output pressure is low and the valve directs compressor output to the liquid receiver, pressure within the liquid receiver will cause a reverse flow of liquid therefrom into the condenser, to raise the liquid level within the condenser and decrease the effective cooling capacity thereof. Thus, under all conditions, liquid level in the condenser will be optimally controlled as a function of system pressure.

BRIEF DESCRIPTION OF THE DRAWING

The single FIGURE shows a schematic diagram of a cooling system employing the present invention.

DESCRIPTION OF THE PREFERRED EMBODIMENT

As shown in the drawing, liquid refrigerant is provided from a liquid receiver or tank 10 through a conduit 11 to an expansion valve 12. The expansion valve 12 sends the liquid refrigerant to an evaporator coil shown schematically at 13, where the refrigerant absorbs heat and turns to vapor which is carried by suction through a line 14 to a vapor compressor 15. The compressor 15 takes the hot gas from the line 14 and increases its pressure before discharging it into a line 16.

In accordance with the principles of the present invention, the compressor discharge line 16 communicates the pressurized gas to a three-way valve 17 which controls and proportions the flow between a conduit 18 leading to the liquid receiver 10 and a conduit 19 leading to a system condenser 20. The conduit 18 communicates to a top portion of the liquid receiver 10 at a hot gas inlet 21. The conduit 19 extends into the condenser 20 at a first opening 22 to a condenser tube 23. The condenser tube 23 emerges from the condenser 20 at a second opening 24 communicating with a reversible-flow line 25 communicating to a portion of the liquid receiver 10 which is below the normal level of liquid therein.

The three-way valve 17 controls flow from the compressor discharge line 16 to the conduits 18 and 19 in accordance with the compressor output pressure in the line 16, the control being accomplished through any conventional mechanism. Shown in the preferred embodiment is a capillary tube 26 communicating to a pressure dome 27 atop the three-way valve 17. The three-way valve operates in three pressure regimes. When compressor output pressure is low such as upon system start-up from cold, the valve will shut off flow to the conduit 19 to the condenser 20 and open fully to conduit 18 to the hot-gas inlet 21 of the liquid receiver 10. When compressor output pressure is high, such as where the cooling load is great and/or ambient temperature about the condenser is high, the three-way valve 17 will open communication fully between the lines 16 and 19 and close off the connection to the conduit 18. At intermediate pressures, the valve 17 will act as a proportional valve, responsive to pressure in the discharge conduit 16 to provide flow to conduit 18 and conduit 19, with more flow to conduit 19 as the pressure in the line 16 increases.

In operation, a refrigerant system using the present invention will discharge the compressor through conduit 16 to three-way valve 17. On a cold start-up, pressure in the refrigerant piping has equalized and the three-way valve control 27, sensing the low equalized pressure, fully closes the valve 17 to conduit 19 and fully opens it to conduit 18. The hot gas is directed to the top of the liquid receiver 10 and as a result of the relative increase in pressure, liquid refrigerant is forced through conduit 25 to the second tube opening 24 of the condenser 20 and into the bottom portion of the condenser tubing 23. Also, liquid is forced into the conduit 11 to the expansion valve 12 for proper feed to the evaporator coil 13. Since upon start-up no condenser surface is exposed to the hot gas, pressure will rapidly rise to an intermediate level for the three-way valve 17. When the pressure exceeds the lower intermediate pressure threshold, the port to conduit 19 begins to open, allowing hot gas to discharge into the condenser 20. As the refrigerant vapor enters the condenser tubes 23, liquid refrigerant flows in conduit 25 from the condenser 20 to the liquid receiver 10. Liquid level is then maintained in the condenser tubes 23 to expose the required condensing surface above the liquid level for required condenser capacity, in response to head pressure.

When maximum condenser capacity is required, the head pressure from the compressor will exceed the intermediate pressure limit on the three-way valve, and the port to conduit 18 will fully close and the port to conduit 19 will be fully open, allowing all the refrigerant hot gas to discharge directly into the condenser 20. The condenser will then operate at maximum capacity, which may be augmented in conventional manner by condenser fans when required.

Although various modifications might be suggested by those versed in the art, it should be understood that I wish to embody within the scope of the patent warranted hereon all such modifications as reasonably and properly come within the scope of my contribution to the art.

I claim as my invention:

1. A method of maintaining balanced liquid level in a refrigerant condenser system, comprising the steps of driving refrigerant through a closed circuit in the form of a stream, at a first point in the stream compressing refrigerant vapor to a pressure;

at a second point directing the compressed vapor to a liquid receiver when the pressure is low, to a vapor condenser when the pressure is high, and proportionately to the liquid receiver and the condenser when the pressure is intermediate, as a function of the pressure;

at a third point directing liquid to the condenser from the liquid receiver in a reversed flow when the pressure is low; and at a fourth point directing liquid to an expansion valve and through an evaporator and back to the said first point, thereby to operate said condenser at optimum capacity when ambient conditions give said condenser system an excess capacity, through control of said liquid level in said condenser.

2. For use in a refrigeration system, a liquid receiver comprising a tank normally containing refrigerant vapor and liquid and having a first opening in a lower portion of said tank for communicating liquid from said tank to an expansion valve, the receiver being particularly characterized by:

an upper portion of said tank having a second opening formed therein for communicating a line carrying vapor from a system compressor upon at least partial opening of a three-way valve in response to a low-pressure compressor output as upon system start-up; and the lower portion of said tank having a third opening separate from said first opening, communicating liquid to and from a line of a vapor condenser, said third opening being disposed so that liquid from said tank will be passed to said condenser when compressor output pressure is low and more than about half of said compressor output vapor enters the tank through said first opening, and said third opening passing liquid from said condenser into said tank when pressure in said compressor output is high, thereby to maintain a balanced liquid level in said condenser and thereby an optimum condenser cooling capacity.

* * * * *